US008979485B2

(12) United States Patent
Baker et al.

(10) Patent No.: US 8,979,485 B2
(45) Date of Patent: Mar. 17, 2015

(54) VARIABLE GEOMETRY TURBINE

(75) Inventors: Glenn L. Baker, Columbus, IN (US); Gary Beshears, Greenwood, IN (US); Timothy James William Proctor, Columbus, IN (US); John Frederick Parker, Huddersfield (GB); John Michael Bywater, Huddersfield (GB)

(73) Assignee: Cummins Ltd., Huddersfield (GB)

( * ) Notice: Subject to any disclaimer, the term of this patent is extended or adjusted under 35 U.S.C. 154(b) by 549 days.

(21) Appl. No.: 13/237,473

(22) Filed: Sep. 20, 2011

(65) Prior Publication Data

US 2012/0189433 A1 Jul. 26, 2012

(30) Foreign Application Priority Data

Sep. 20, 2010 (GB) ..... 1015679.2

(51) Int. Cl.
*F01D 17/14* (2006.01)
*F01D 17/16* (2006.01)

(52) U.S. Cl.
CPC ..... *F01D 17/14* (2013.01); *F01D 17/167* (2013.01); *F05D 2220/40* (2013.01)
USPC ..... 415/158

(58) Field of Classification Search
CPC .... F01D 17/14; F01D 17/167; F05D 2220/40
USPC ..... 415/148, 151, 157, 158; 416/223 B
See application file for complete search history.

(56) References Cited

U.S. PATENT DOCUMENTS 2,759,778 A * 8/1956 Anderson ..... 384/480
2,877,945 A * 3/1959 Trebilcock ..... 416/171
3,754,833 A * 8/1973 Remberg ..... 415/108
4,292,000 A * 9/1981 Baldwin et al. ..... 403/320
5,263,312 A * 11/1993 Walker et al. ..... 60/797
5,522,697 A * 6/1996 Parker et al. ..... 415/158
6,224,333 B1 5/2001 Loeffler et al.

(Continued)

FOREIGN PATENT DOCUMENTS

EP 0 678 657 A2 10/1995
EP 1435434 A2 7/2004

(Continued)

OTHER PUBLICATIONS

United Kingdom Search Report GB1015679.2, Cummins Ltd., May 9, 2011.

*Primary Examiner* — Nathaniel Wiehe
*Assistant Examiner* — Eldon Brockman
(74) *Attorney, Agent, or Firm* — Krieg DeVault LLP

(57) ABSTRACT

A variable geometry turbine comprising: a housing; a turbine wheel supported in the housing for rotation; an annular inlet passage defined between respective inlet surfaces defined by an annular nozzle ring and a facing annular shroud; the nozzle ring can vary the size of the inlet passage; a circumferential array of inlet vanes; the shroud covering the opening of a shroud cavity defined by the housing inlet passage and inboard of the shroud, and defining a circumferential array of slots, the slots and shroud cavity being configured to receive said vanes accommodating movement of the nozzle ring; wherein the annular shroud comprises an outer flange, the outer flange defining a circumferential groove for receiving a retaining ring for securing the shroud in the opening of the shroud cavity and defined on an inboard side by a flange wall; wherein an annular flange rim extends axially inboard from said flange wall.

18 Claims, 10 Drawing Sheets

(56) References Cited

U.S. PATENT DOCUMENTS

| | | | | |
|---|---|---|---|---|
| 6,776,574 | B1 * | 8/2004 | Parker | 415/158 |
| 7,055,826 | B2 * | 6/2006 | Stewart, Jr. | 277/358 |
| 7,108,481 | B2 * | 9/2006 | Mulloy et al. | 415/158 |
| 7,140,849 | B2 * | 11/2006 | Carter | 417/407 |
| 7,475,540 | B2 * | 1/2009 | Parker | 60/602 |
| 7,658,068 | B2 * | 2/2010 | Mulloy et al. | 60/602 |
| 2002/0136630 | A1 * | 9/2002 | Jinnai et al. | 415/1 |
| 2003/0010029 | A1 * | 1/2003 | Lutz et al. | 60/602 |
| 2003/0025273 | A1 * | 2/2003 | Stewart, Jr. | 277/345 |
| 2004/0247462 | A1 * | 12/2004 | Carter | 417/407 |
| 2005/0212283 | A1 * | 9/2005 | Frost et al. | 285/92 |
| 2005/0262841 | A1 * | 12/2005 | Parker | 60/602 |
| 2006/0010864 | A1 * | 1/2006 | Mulloy et al. | 60/602 |
| 2007/0126233 | A1 * | 6/2007 | Gashgaee | 285/384 |
| 2007/0283693 | A1 * | 12/2007 | Mulloy et al. | 60/598 |
| 2008/0089782 | A1 * | 4/2008 | Parker et al. | 415/150 |
| 2008/0223956 | A1 * | 9/2008 | Jinnai et al. | 239/265.35 |
| 2008/0283101 | A1 * | 11/2008 | Pardini | 134/174 |
| 2009/0064679 | A1 * | 3/2009 | Parker | 60/602 |
| 2009/0092483 | A1 * | 4/2009 | Yasui et al. | 415/159 |
| 2009/0097969 | A1 * | 4/2009 | Spuler | 415/159 |
| 2009/0142186 | A1 * | 6/2009 | Parker | 415/159 |
| 2009/0313991 | A1 * | 12/2009 | Kuznicki et al. | 60/605.1 |
| 2010/0037605 | A1 * | 2/2010 | Garrett et al. | 60/602 |
| 2010/0043431 | A1 * | 2/2010 | Thayer et al. | 60/605.3 |
| 2010/0139270 | A1 * | 6/2010 | Koch et al. | 60/605.3 |
| 2010/0143099 | A1 * | 6/2010 | Bywater et al. | 415/148 |
| 2010/0150701 | A1 * | 6/2010 | Simon et al. | 415/160 |
| 2011/0011077 | A1 * | 1/2011 | Kozuka et al. | 60/445 |
| 2011/0011085 | A1 * | 1/2011 | Garrett et al. | 60/615 |
| 2011/0236197 | A1 * | 9/2011 | Burmeister et al. | 415/204 |
| 2011/0243721 | A1 * | 10/2011 | Alajbegovic et al. | 415/204 |
| 2011/0283697 | A1 * | 11/2011 | Hirth | 60/605.1 |
| 2011/0296829 | A1 * | 12/2011 | Hayashi et al. | 60/602 |

FOREIGN PATENT DOCUMENTS

| | | | |
|---|---|---|---|
| GB | 2 271 814 | A | 4/1994 |
| GB | 2 446 323 | A | 8/2008 |
| GB | 2 462 115 | A | 1/2010 |
| WO | 2004048755 | A1 | 6/2004 |

* cited by examiner

G-G

VARIABLE GEOMETRY TURBINE

RELATED APPLICATION

The present application is related to, and claims priority to United Kingdom Patent Application No. 1015679.2 filed on Sep. 20, 2010, which is incorporated herein by reference.

The present invention relates to a variable geometry turbine. Particularly, but not exclusively, the present invention relates to a variable geometry turbine for a turbocharger or other turbomachine.

A turbomachine comprises a turbine. A conventional turbine comprises an exhaust gas driven turbine wheel mounted on a rotatable shaft within a turbine housing connected downstream of an engine outlet manifold. Rotation of the turbine wheel drives either a compressor wheel mounted on the other end of the shaft within a compressor housing to deliver compressed air to an engine intake manifold, or a gear which transmits mechanical power to an engine flywheel or crankshaft. The turbine shaft is conventionally supported by journal and thrust bearings, including appropriate lubricating systems, located within a bearing housing.

Turbochargers are well known devices for supplying air to the intake of an internal combustion engine at pressures above atmospheric pressure (boost pressures). Turbochargers comprise a turbine having a turbine housing which defines a turbine chamber within which the turbine wheel is mounted; an annular inlet passageway defined between opposite radial walls arranged around the turbine chamber; an inlet arranged around the inlet passageway; and an outlet passageway extending from the turbine chamber. The passageways and chambers communicate such that pressurised exhaust gas admitted to the inlet chamber flows through the inlet passageway to the outlet passageway via the turbine and rotates the turbine wheel. Turbine performance can be improved by providing vanes, referred to as nozzle vanes, in the inlet passageway so as to deflect gas flowing through the inlet passageway towards the direction of rotation of the turbine wheel.

Turbines may be of a fixed or variable geometry type. Variable geometry turbines differ from fixed geometry turbines in that the size of the inlet passageway can be varied to optimise gas flow velocities over a range of mass flow rates so that the power output of the turbine can be varied to suite varying engine demands. For instance, when the volume of exhaust gas being delivered to the turbine is relatively low, the velocity of the gas reaching the turbine wheel is maintained at a level which ensures efficient turbine operation by reducing the size of the annular inlet passageway. Turbochargers provided with a variable geometry turbine are referred to as variable geometry turbochargers.

In one known type of variable geometry turbine, an array of vanes, generally referred to as a "nozzle ring", is disposed in the inlet passageway and serves to direct gas flow towards the turbine. The axial position of the nozzle ring relative to a facing wall of the inlet passageway is adjustable to control the axial width of the inlet passageway. The nozzle ring vanes extend into the inlet and through vane slots provided in a "shroud" defining the facing wall of the inlet passageway to accommodate movement of the nozzle ring. Thus, for example, as gas flow through the turbine decreases, the inlet passageway width may be decreased to maintain gas velocity and optimise turbine output. This arrangement differs from another type of variable geometry turbine in which a variable guide vane array comprises adjustable swing guide vanes arranged to pivot so as to open and close the inlet passageway.

The known shroud comprises an annular plate which seats in the mouth of an annular shroud cavity. The shroud plate is held in position by a retaining ring located in a circumferential groove provided in the outer periphery of the shroud plate and extending into a circumferential groove provided in the turbine housing around the mouth of the shroud cavity. The retaining ring is a split ring of a form commonly referred to as a "piston ring".

The nozzle ring may typically comprise a radially extending wall (defining one wall of the inlet passageway) and radially inner and outer axially extending walls or flanges which extend into an annular cavity behind the radial face of the nozzle ring. The cavity is formed in a part of the turbocharger housing (usually either the turbine housing or the turbocharger bearing housing) and accommodates axial movement of the nozzle ring. The flanges may be sealed with respect to the cavity walls to reduce or prevent leakage flow around the back of the nozzle ring.

In one arrangement of a variable geometry turbine the nozzle ring is supported on rods extending parallel to the axis of rotation of the turbine wheel and is moved by an actuator which axially displaces the rods. Nozzle ring actuators can take a variety of forms, including pneumatic, hydraulic and electric and can be linked to the nozzle ring in a variety of ways. The actuator will generally adjust the position of the nozzle ring under the control of an engine control unit (ECU) in order to modify the airflow through the turbine to meet performance requirements.

During the lifetime of a turbine the shroud retaining ring and/or the shroud itself may be subject to wear and fatigue. It is an object of the present invention to reduce such wear/fatigue.

According to a first aspect of the present invention there is provided a variable geometry turbine comprising: a housing; a turbine wheel supported in the housing for rotation about a turbine axis; an annular inlet passage upstream of said turbine wheel defined between respective inlet surfaces defined by an annular nozzle ring and a facing annular shroud; the nozzle ring being axial movable to vary the size of the inlet passage; a circumferential array of inlet vanes supported by the nozzle ring and extending across the inlet passage; the shroud covering the opening of a shroud cavity defined by the housing inlet passage and inboard of the shroud, and defining a circumferential array of vane slots, the vane slots and shroud cavity being configured to receive said inlet vanes to accommodate axial movement of the nozzle ring; wherein the annular shroud comprises an outer flange around its radially outer periphery, the outer flange defining a circumferential flange groove for receiving a retaining ring for securing the shroud in the opening of the shroud cavity, the flange groove being defined on an inboard side by a radially extending flange wall; wherein an annular flange rim extends axially inboard from said radial flange wall.

Preferably the annular shroud rim is a continuation of an axially extending annular flange wall which defines an annular base of the flange groove and extending axially beyond said radial flange wall.

An annular gap is preferably defined between the shroud flange rim and inner surface of the housing defining a portion of the shroud cavity, wherein said annular gap increases in radial width along the length of the flange rim towards the inboard end of the flange rim.

The annular flange rim may have a radially outer surface and a radially inner surface, and wherein the radius of the radial outer surfaces reduces towards the inboard end of the rim.

The radius of the inner surface of the flange rim may be substantially constant, so that the flange rim tapers along its length towards its inboard end.

According to a second aspect of the present invention there is provided a variable geometry turbine comprising: a housing; a turbine wheel supported in the housing for rotation about a turbine axis; an annular inlet passage upstream of said turbine wheel defined between respective inlet surfaces defined by an annular nozzle ring and a facing annular shroud; the nozzle ring being axial movable to vary the size of the inlet passage; a circumferential array of inlet vanes supported by the nozzle ring and extending across the inlet passage; the shroud covering the opening of a shroud cavity defined by the housing inlet passage and inboard of the shroud, and defining a circumferential array of vane slots, the vane slots and shroud cavity being configured to receive said inlet vanes to accommodate axial movement of the nozzle ring; wherein the annular shroud comprises an outer flange around its radially outer periphery, the outer flange defining a circumferential flange groove for receiving a retaining ring for securing the shroud in the opening of the shroud cavity, the flange groove being defined on an inboard side by a radially extending flange wall; wherein the retaining ring is a substantially annular split ring having a radially inner portion received within the flange groove and the radially outer portion received within an annular groove defined by the housing to thereby key the shroud in position in the mouth of the shroud cavity; the housing groove having an outboard sidewall, a base and an inboard side wall; wherein the outboard face of the radially outer portion of the retaining ring and the outboard sidewall of the housing groove define corresponding frusto-conical surfaces which cooperate to bias the retaining ring in an inboard direction under a radial spring force of the retaining ring, thereby urging a portion of the shroud into contact with an abutment surface defined by the housing to secure the shroud in position in the mouth of the shroud cavity; and wherein the axial width of the housing groove is such that the inboard wall of the housing groove is spaced from the inboard surface of the radially outer portion of the retaining ring so that there is no contact between the two.

Preferably the axial spacing between the inboard wall of the radially outer portion of the retaining ring and the inboard wall of the housing groove is at least equal to the maximum width of the retaining ring.

It is preferred that the inboard wall of the housing groove extends to a smaller radius than the outer radius of the shroud, and wherein an axial gap is defined between said inboard wall of the housing groove and the outer flange of the shroud.

The portion of the shroud which is urged against an abutment surface of the housing may be at the radially inner periphery of the shroud. Said portion of the shroud which is urged into contact with an abutment surface of the housing, may be an axially extending inboard flange at the radially inner periphery of the shroud.

The portion of the shroud urged into contact with a abutment surface of the housing is preferably a portion of the radially outer flange.

According to a third aspect of the present invention there is provided a variable geometry turbine comprising: a housing; a turbine wheel supported in the housing for rotation about a turbine axis; an annular inlet passage upstream of said turbine wheel defined between respective inlet surfaces defined by an annular nozzle ring and a facing annular shroud; the nozzle ring being axial movable to vary the size of the inlet passage; a circumferential array of inlet vanes supported by the nozzle ring and extending across the inlet passage; the shroud covering the opening of a shroud cavity defined by the housing inlet passage and inboard of the shroud, and defining a circumferential array of vane slots, the vane slots and shroud cavity being configured to receive said inlet vanes to accommodate axial movement of the nozzle ring; wherein the annular shroud comprises a radially extending outer flange wall around its radially outer periphery; wherein the housing defines an internally screw threaded annular surface around the opening of the shroud cavity; and wherein the shroud is retained in position by a retaining ring provided with a screw threaded outer surface which engages said screw threaded surface of the housing and wherein a portion of the retaining ring bears against the outer flange of the shroud.

Preferably the retaining ring has a radially extending outboard portion and an axially extending inboard portion, wherein said inboard portion defines said screw threaded surface for engagement with the screw threaded surface of the housing, and wherein the radially extending outboard portion bears against the outer flange of the shroud.

The outer flange of the shroud may be trapped between the radially extending portion of the retaining ring and an annular support ring located within the opening of the shroud cavity.

It is preferred that the shroud has an inner annular flange extending radially inboard at its inner periphery, and wherein the inboard end of the inner flange is urged against an abutment surface of the housing by axial force applied to the shroud by the retaining ring.

The radially extending outer flange of the shroud preferably extends radially from the inboard end of an axially extending shroud flange wall. A radial outboard surface of the retaining ring may be substantially aligned with the radial outboard surface of the shroud.

According to a fourth aspect of the present invention there is provided a variable geometry turbine comprising: a housing; a turbine wheel supported in the housing for rotation about a turbine axis; an annular inlet passage upstream of said turbine wheel defined between respective inlet surfaces defined by an annular nozzle ring and a facing annular shroud; the nozzle ring being axial movable to vary the size of the inlet passage; a circumferential array of inlet vanes supported by the nozzle ring and extending across the inlet passage; the shroud covering the opening of a shroud cavity defined by the housing inlet passage and inboard of the shroud, and defining a circumferential array of vane slots, the vane slots and shroud cavity being configured to receive said inlet vanes to accommodate axial movement of the nozzle ring; wherein the shroud comprises an annular wall defining said vane slots and having radial outboard and inboard surfaces; the outboard surface of the annular shroud wall having a radial width A; the annular shroud wall having an axial thickness C between its outboard and inboard surfaces; wherein an axial flange extends inboard of the shroud wall around its radial inner periphery, said inner flange extending a distance B from the inboard surface of the radial shroud wall; wherein the ratio A:B is equal to or less than about 5 and/or the ratio B:C is equal to or greater than about 1.5.

The ratio A:B may be at least 3. The ratio B:C may be less than 5.

Specific embodiments of the present invention will now be described, by way of example only, with reference to the accompanying drawings, in which.

Figure 4A:
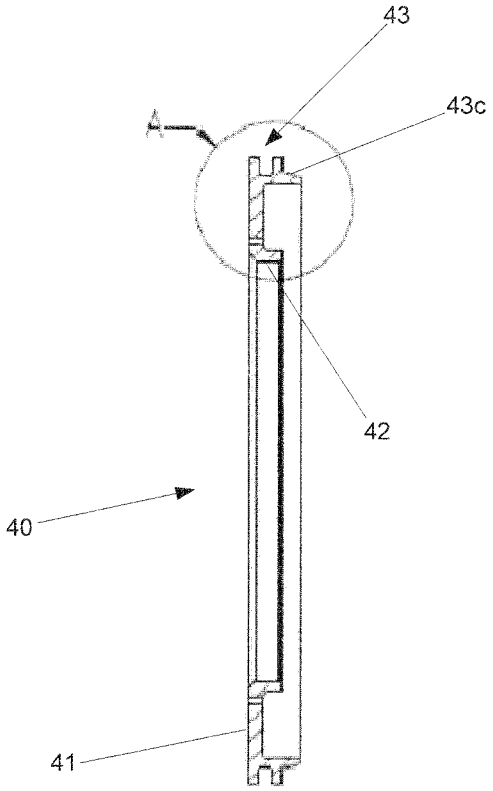
Figure 4B:
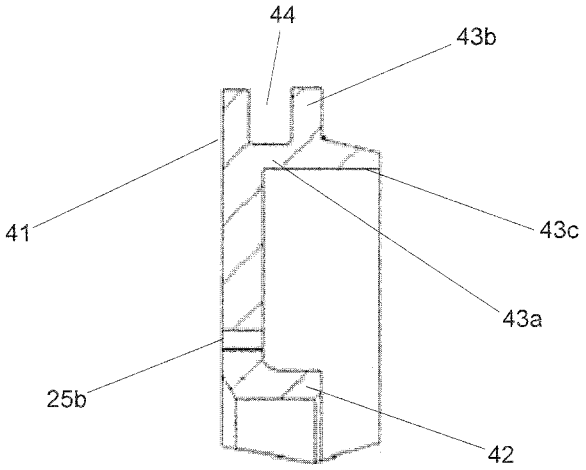
Figure 5:
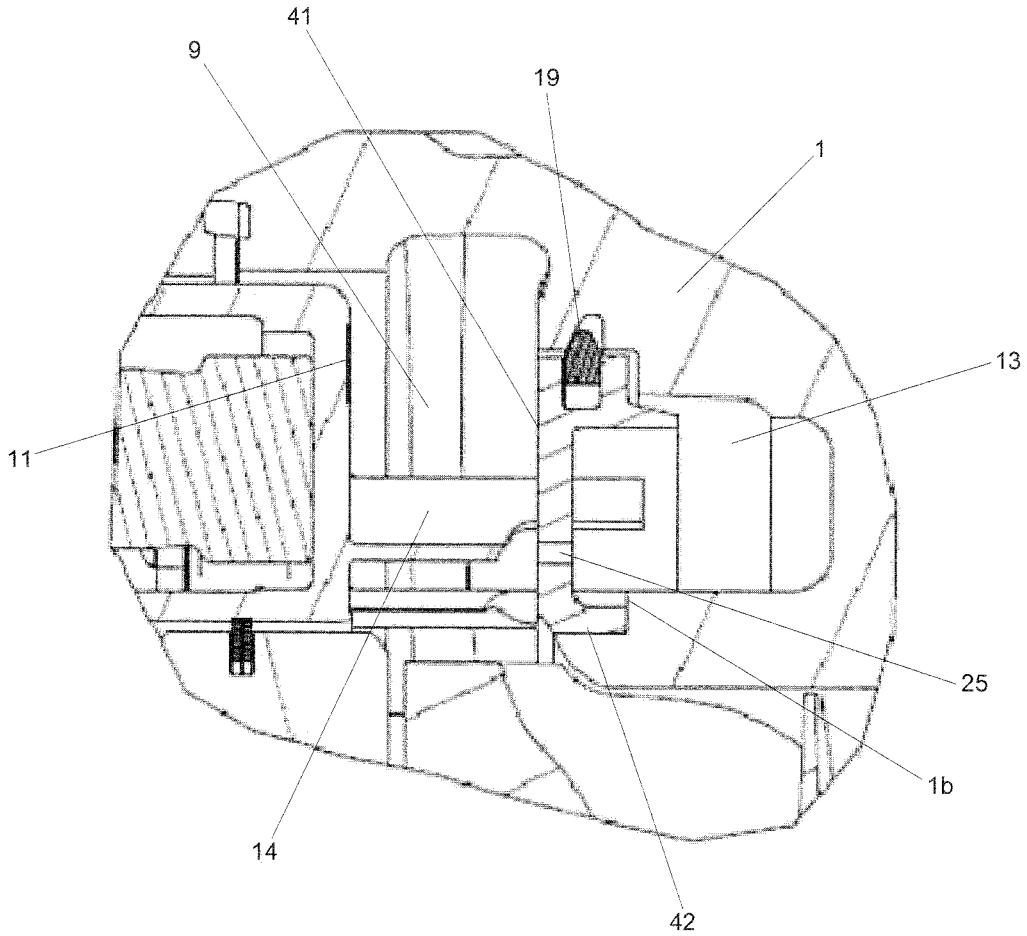
Figure 6:
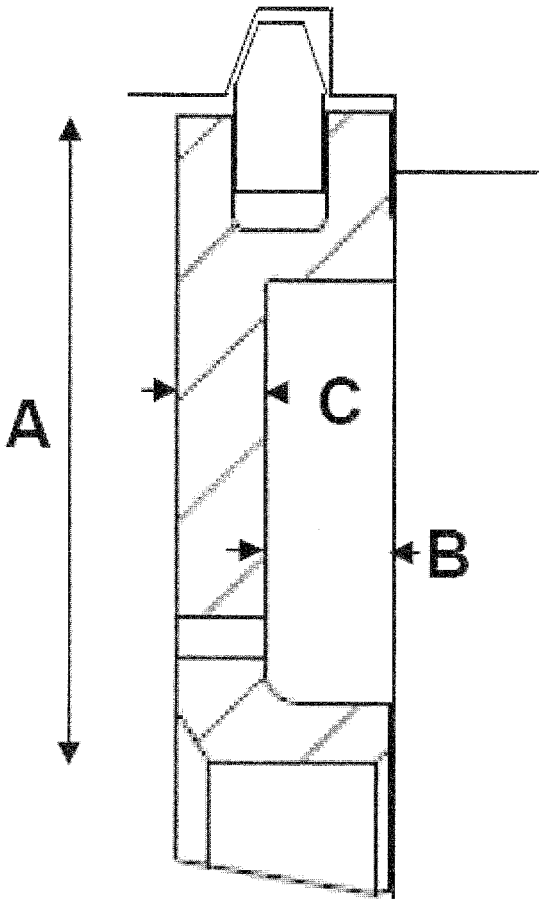
Figure 7:
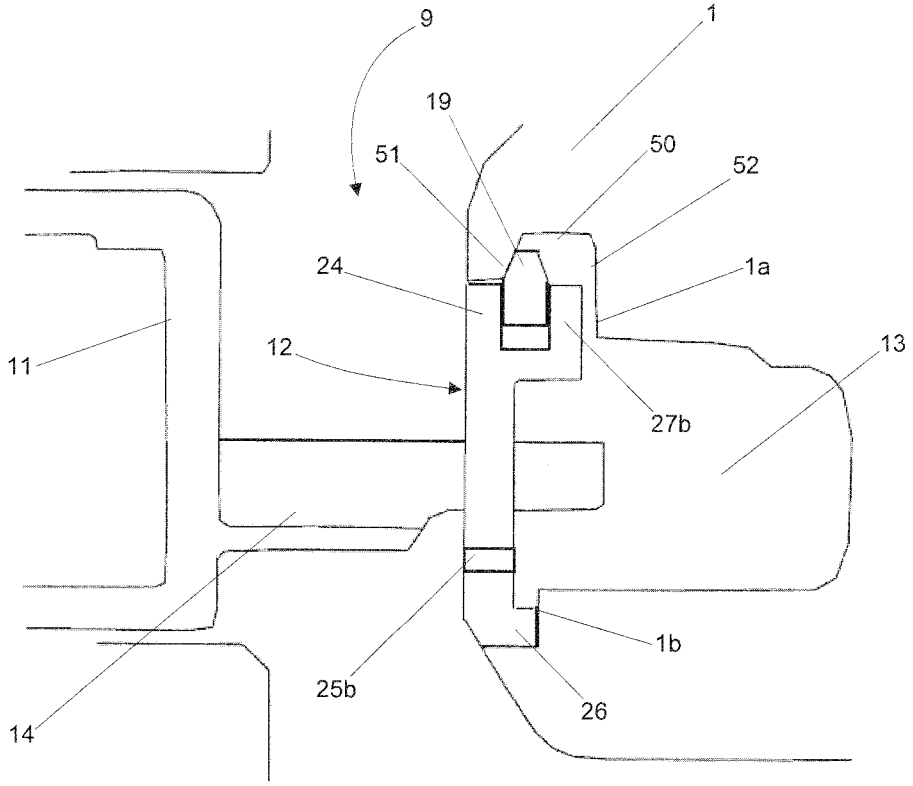
Figure 8:
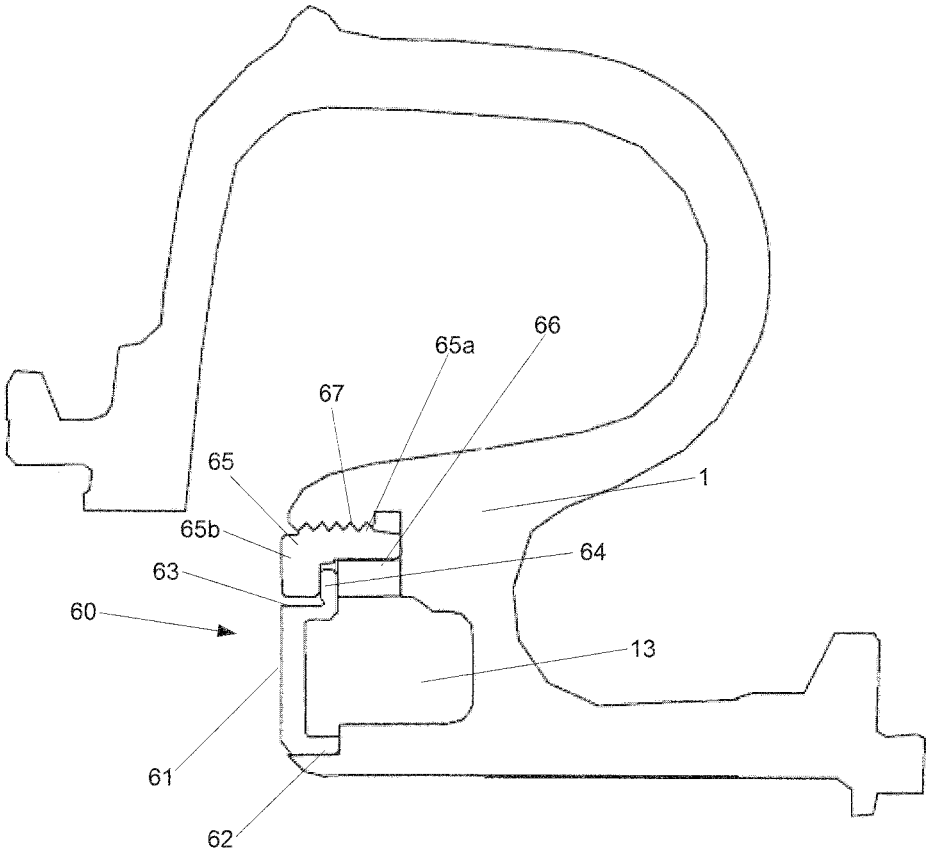
Figure 9:
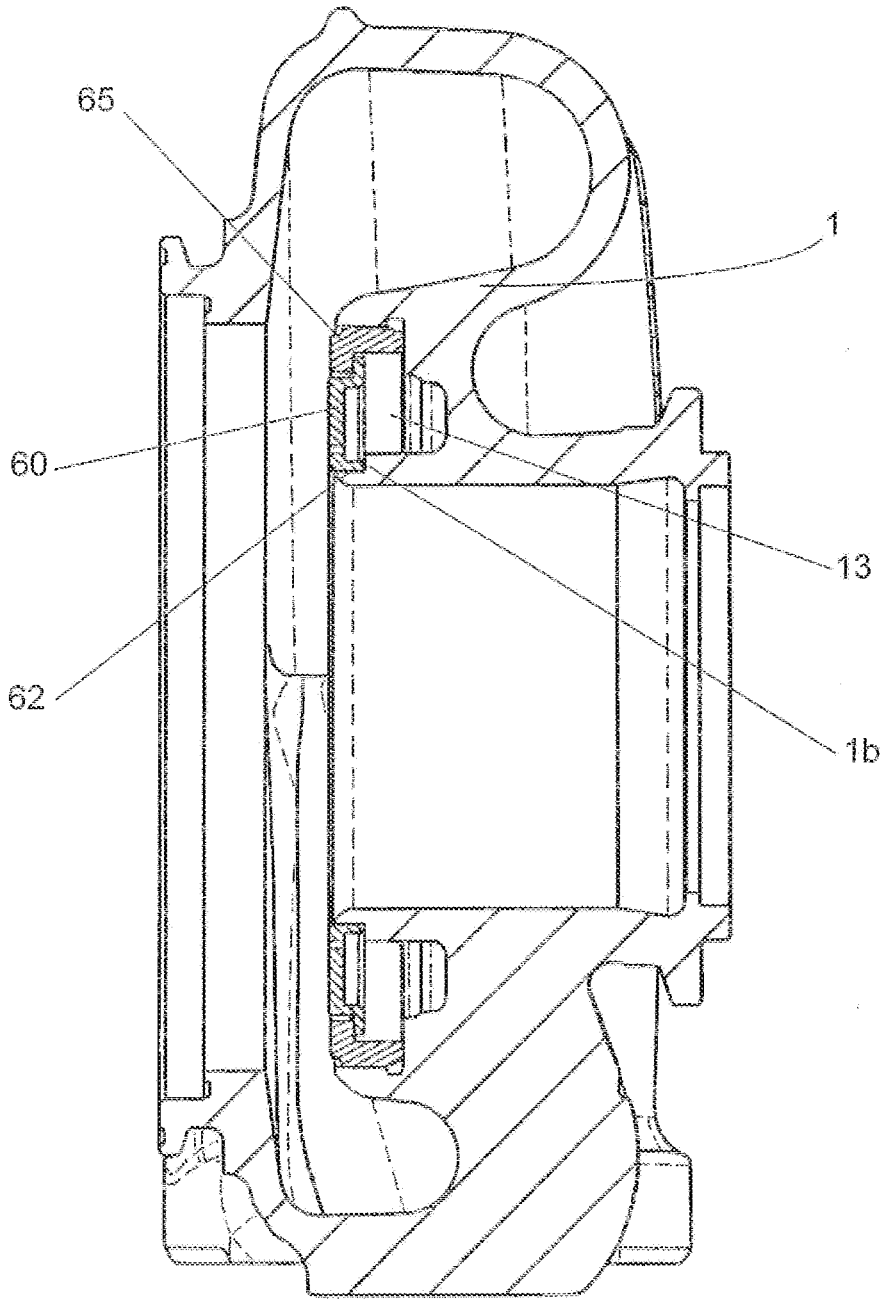

FIGS. 4*a* and 4*b* are sectional views of a first embodiment of a shroud according to the present invention;

FIG. 5 is a sectional view of part of a turbocharger turbine including the shroud of FIGS. 4*a* and 4*b* in accordance with the present invention;

FIG. 6 is a schematic sectional view of a second embodiment of the present invention;

FIG. 7 is a schematic view of a third embodiment of the present invention;

FIG. 8 is a sectional view of a fourth embodiment of the present invention; and FIG. 9 is a sectional view illustrating a fifth embodiment of the present invention.

Figure 1:
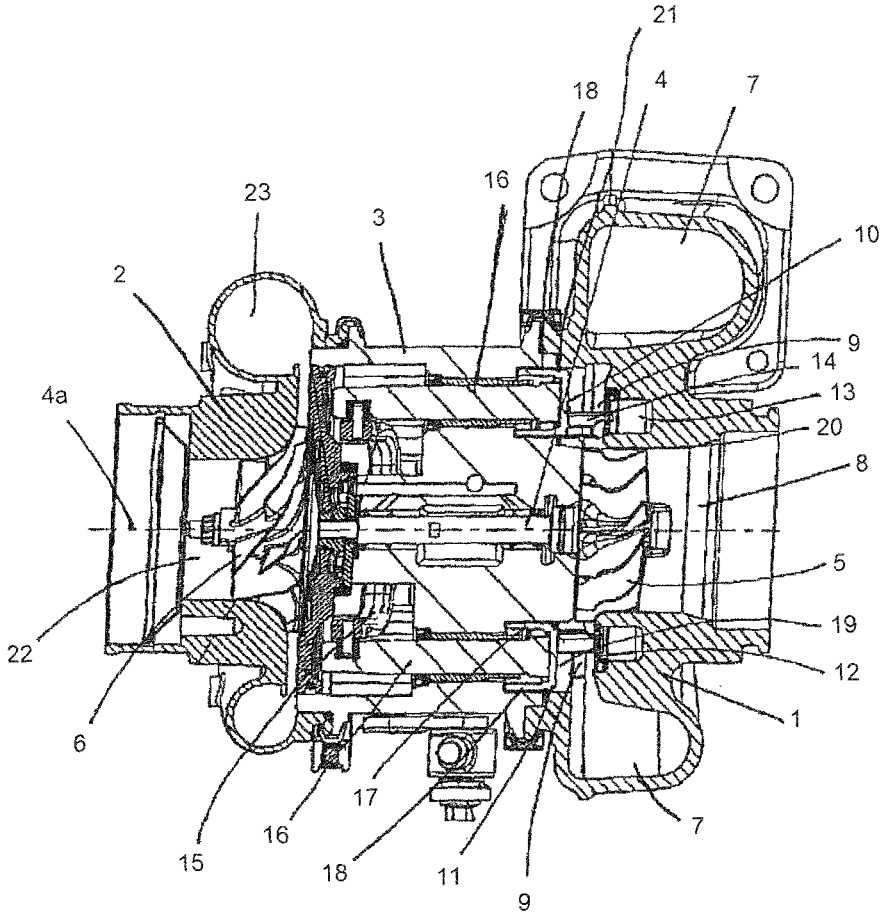
FIG. 1 is an axial cross-section through a known variable geometry turbocharger.

Referring to FIG. 1, this illustrates a known variable geometry turbocharger comprising a variable geometry turbine housing 1 and a compressor housing 2 interconnected by a central bearing housing 3. A turbocharger shaft 4 extends from the turbine housing 1 to the compressor housing 2 through the bearing housing 3. A turbine wheel 5 is mounted on one end of the shaft 4 for rotation within the turbine housing 1, and a compressor wheel 6 is mounted on the other end of the shaft 4 for rotation within the compressor housing 2. The shaft 4 rotates about turbocharger axis 4*a* on bearing assemblies located in the bearing housing 3.

The turbine housing 1 defines an inlet volute 7 to which gas from an internal combustion engine (not shown) is delivered. The exhaust gas flows from the inlet volute 7 to an axial outlet passageway 8 via an annular inlet passageway 9 and the turbine wheel 5. The inlet passageway 9 is defined on one side by a face 10 of a radial wall of a movable annular wall member 11, referred to as a "nozzle ring", and on the opposite side by a second wall member comprising an annular shroud 12 which forms the wall of the inlet passageway 9 facing the nozzle ring 11. The shroud 12 covers the opening of an annular recess, or shroud cavity, 13 in the turbine housing 1.

The nozzle ring 11 supports an array of circumferentially and equally spaced inlet vanes 14 each of which extends across the inlet passageway 9. The vanes 14 are orientated to deflect gas flowing through the inlet passageway 9 towards the direction of rotation of the turbine wheel 5. The vanes 14 project through suitably configured slots in the shroud 12, and into the shroud cavity 13, to accommodate movement of the nozzle ring 11.

The position of the nozzle ring 11 is controlled by an actuator assembly of the type disclosed in U.S. Pat. No. 5,868,552. An actuator (not shown) is operable to adjust the position of the nozzle ring 11 via an actuator output shaft (not shown), which is linked to a yoke 15. The yoke 15 in turn engages axially extending actuating rods 16 that support the nozzle ring 11. Accordingly, by appropriate control of the actuator (which may for instance be pneumatic or electric), the axial position of the rods 16 and thus of the nozzle ring 11 can be controlled. The speed of the turbine wheel 5 is dependent upon the velocity of the gas passing through the annular inlet passageway 9. For a fixed rate of mass of gas flowing into the inlet passageway 9, the gas velocity is a function of the width of the inlet passageway 9, the width being adjustable by controlling the axial position of the nozzle ring 11. FIG. 1 shows the annular inlet passageway 9 fully open. The inlet passageway 9 may be closed to a minimum by moving the face 10 of the nozzle ring 11 towards the shroud 12.

The nozzle ring 11 has axially extending radially inner and outer annular flanges 17 and 18 that extend into an annular cavity 19 provided in the turbine housing 1. Inner and outer sealing rings 20 and 21 are provided to seal the nozzle ring 11 with respect to inner and outer annular surfaces of the annular cavity 19 respectively, whilst allowing the nozzle ring 11 to slide within the annular cavity 19. The inner sealing ring 20 is supported within an annular groove formed in the radially inner annular surface of the cavity 19 and bears against the inner annular flange 17 of the nozzle ring 11. The outer sealing ring 20 is supported within an annular groove formed in the radially outer annular surface of the cavity 19 and bears against the outer annular flange 18 of the nozzle ring 11.

Gas flowing from the inlet volute 7 to the outlet passageway 8 passes over the turbine wheel 5 and as a result torque is applied to the shaft 4 to drive the compressor wheel 6. Rotation of the compressor wheel 6 within the compressor housing 2 pressurises ambient air present in an air inlet 22 and delivers the pressurised air to an air outlet volute 23 from which it is fed to an internal combustion engine (not shown).

Figure 2A:
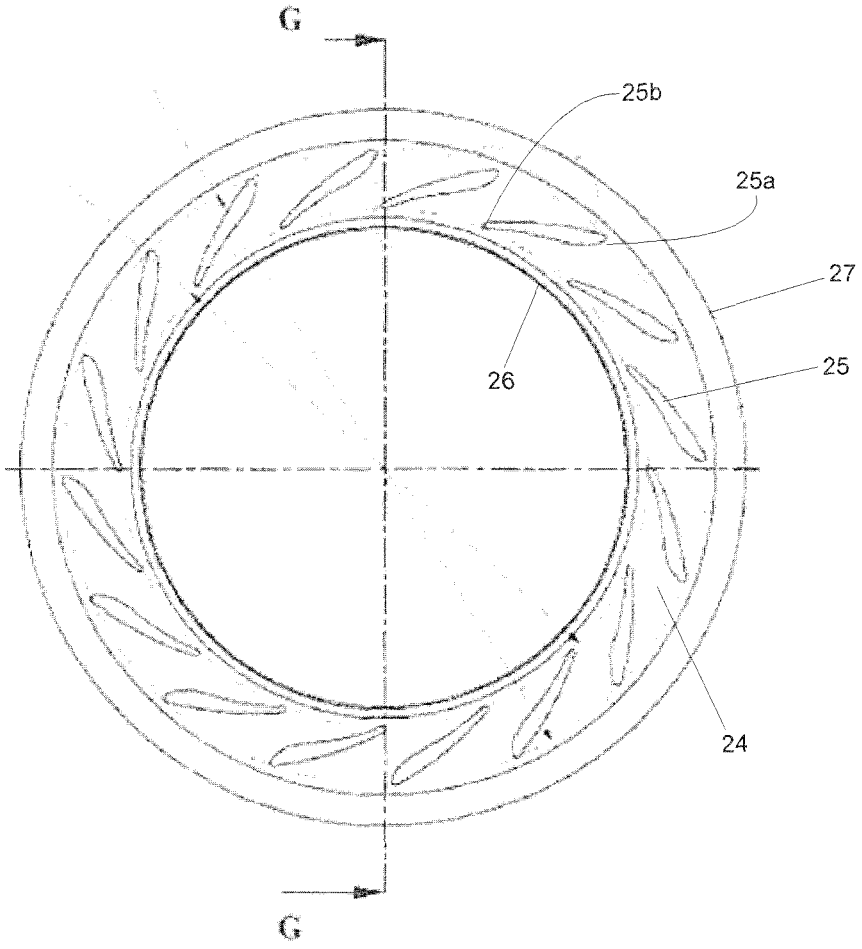
FIG. 2A is a front view of a prior art shroud for use in a variable geometry turbine.
Figure 2B:
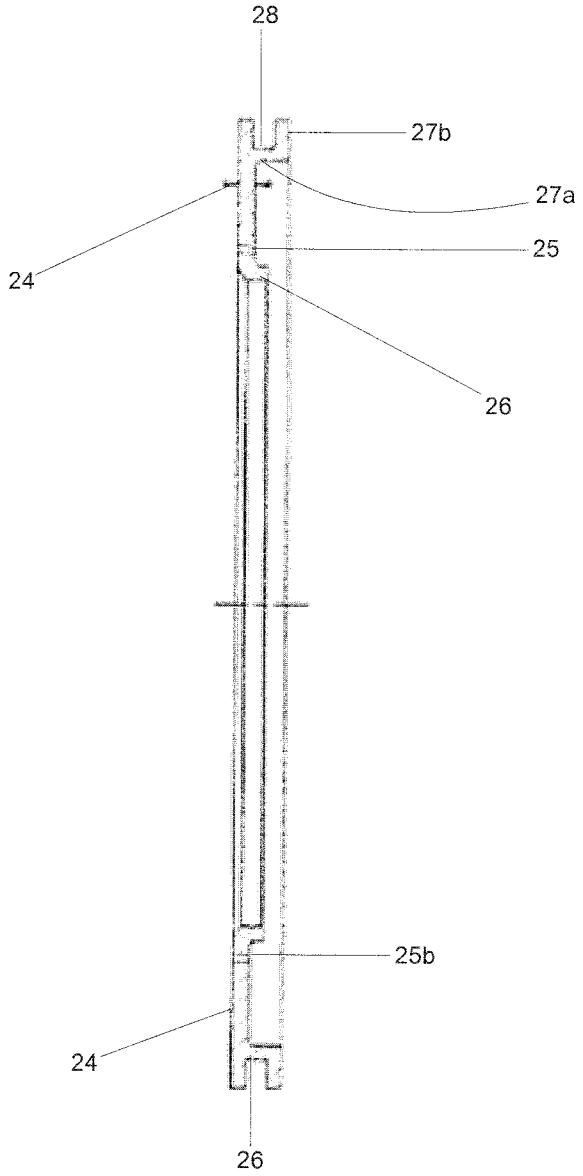
FIG. 2B is a cross-sectional view taken along line G-G of the shroud of FIG. 2A.

The shroud 12 of the turbocharger of FIG. 1 is shown in greater detail in FIGS. 2A and 2B. The shroud is an annular plate comprising a radially extending shroud wall 24 provided with vane slots 25 for the receipt of the vanes 14 of the nozzle ring 11. The vane slots 25 are best seen in FIG. 2A, each slot having a leading end 25*a* and a trailing end 25*b*. The trailing end 25*b* of two of the slots 25 is visible in the cross-section of FIG. 2*b*. The radially inner periphery of the annular shroud wall 24 is formed with an axially extending flange 26, which extends in an inboard direction away from the turbine inlet 9 when the shroud 12 is in position in the turbine housing, and provides means for seating the inner periphery of the shroud 12 in the mouth of the shroud cavity 13.

The radially outer periphery of the shroud plate 24 is formed with a grooved flange 27. The flange 27 extends axially inboard from the shroud plate wall 24 to a greater extent than the inner shroud 26, and defines an annular groove 28 around the radially outer periphery of the shroud. In more detail, the grooved flange 27 comprises an axially extending flange wall 27*a* and a radially extending flange wall 27*b*, the groove 28 being defined between the outer periphery of the shroud wall 24 and the radially extending flange wall 27*b*, the base of the groove 28 being defined by the axially extending flange wall 27*a*. The overall configuration is generally "h" shaped.

Figure 3:
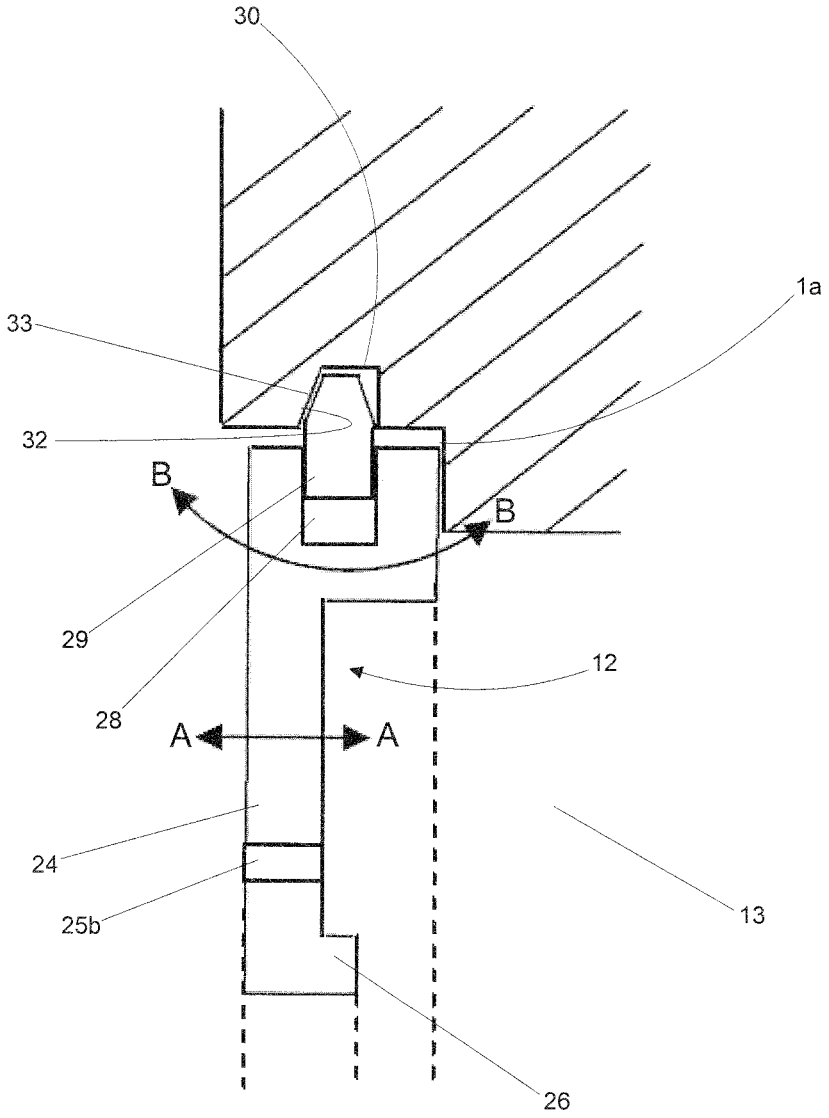
FIG. 3 is a schematic illustration of the prior art shroud of FIGS. 2*a* and 2*b* installed in a turbine housing.

FIG. 3 schematically illustrates mounting of the known shroud plate 12 of FIGS. 2*a* and 2*b* to a turbine housing 1. Specifically, FIG. 3 schematically illustrates the manner in which the outer periphery of the shroud 12 is secured in the opening, or mouth, of the shroud cavity 13. A retaining ring 29 (which may have the from of a conventional "piston ring") is located within the groove 28 of the shroud 12. The retaining ring is a split ring which can be radially compressed to allow the shroud 12 to be slid into the mouth of the shroud cavity 13. As the shroud 12 is fitted in position, the groove 28 aligns with an annular groove 30 defined around the mouth of the shroud cavity 13. The housing 1 is also formed with a radial extending annular shoulder 1*a*. With the grooves 28 and 30 aligned, the retaining ring 29 springs radially outwards to engage the groove 30 and secure the shroud 12 in position. The radially outer periphery of the retaining ring 29 tapers defining a conical outboard surface 32 which engages with a complimentary conical surface defined by an outboard side wall 33 of the groove 30. Interaction of the surfaces 32 and 33 as the retaining ring 29 radially expands into the groove 30 biases the shroud 12 axially inwards into the mouth of the shroud cavity 13 to ensure the shroud 12 is firmly located in position.

FIG. 4*a* is a cross-section of a shroud 40 in accordance with an embodiment of the present invention. FIG. 4*b* is an enlarged view of detail of the shroud 40. It can be see that the shroud 40 has many features in common with the shroud 12. That is, shroud 40 is an annular plate comprising a radially extending shroud wall 41 provided with an axial extending flange 42 at its inner periphery, and a grooved shroud flange 43 at its outer periphery. Moreover, flange 43 comprises an axially extending flange wall 43*a* and a radially extending flange wall 43*b*, with a flange groove 44 defined between the shroud wall 41 and the radially extending flange wall 43*b*.

In accordance with a first aspect of the present invention the flange wall 43*a* extends axially inboard beyond the radially extending flange wall 43*b*, to form an axially extending annular flange rim 43*c*. The radially inner surface of the rim 43*c* is a continuation of the radial inner surface of flange wall 43*a*. The radially outer surface of the rim 43*c* is tapered, reducing in diameter towards the axial end of the rim 43*c*.

In accordance with a fourth aspect of the present invention the radially inner flange 42 is axially extended relative to the inner flange 26 of the prior art shroud 12.

FIG. 5 illustrates the shroud of FIGS. 4*a* and 4*b* fitted to a turbocharger turbine, showing part of a turbocharger turbine of the general type illustrated in FIG. 1, and thus reference numerals used in FIG. 1 will be used in FIG. 5 where appropriate. The shroud 40 according to the present invention is shown fitted within the mouth of the shroud cavity 13 defined by a turbine housing 1. The radial shroud plate wall 41 defines one side wall of the turbine inlet 9, the opposing side wall being defined by nozzle ring 11. Nozzle vanes 14 are supported by the nozzle ring 11 and extend across the inlet 9 through the shroud vane slots 25, and into the shroud cavity 13. Operation of this variable geometry turbine is the same operation of the variable geometry turbine of FIG. 1.

The shroud 20 is secured in position by retaining ring 19 which operates in the same manner as the retaining ring 19 of prior art shroud 12. The axially extended inner shroud flange 42 abuts against a radially extending annular shoulder 1*b* defined by the housing 1. It will be noted that the radially extending flange wall 43*b* does not abut against the housing shoulder 1*a*, but the axially extending inner flange 42 does abut against the housing shoulder 1*b*. The spring action of the retaining ring 19, and the interaction of the outboard conical surfaces of the retainer ring 19 and the housing groove 18, bias the shroud inwardly effectively maintaining the shroud in position against the reactive force exerted by housing shoulder 1*b* on the inner shroud flange 42.

The flange rim 43*c* extends into the shroud cavity 13 beyond the housing shoulder 1*a*, a radial spacing between the flange rim 43*c* and the cavity wall increasing along the axial length of the rim 43*c* by virtue of its tapered configuration.

The inventors have found that certain wear exhibited in the known shroud 12 in the region of the retaining ring 19 can surprisingly be attributed to flexing of the shroud plate wall 24 in an axial direction illustrated by arrows A-A of FIG. 3, causing a rocking motion at the periphery of the shroud plate as illustrated by arrows B-B in FIG. 3. Moreover, the inventors have demonstrated that provision of the axially extended flange rim 43*c* sufficiently stiffens the flange 41 against such movement to at least significantly reduce wear in the shroud according to the first aspect of the present invention.

The inventors have also surprisingly found that the above mentioned flexing of the shroud plate can be the cause of crack formation in the region of the trailing edge of the shroud vane slots 25*b* in the prior art shroud 12. Moreover, the inventors have found that this can be substantially prevented by axially extending the inner shroud flange 42 in accordance with the fourth aspect of the present invention as illustrated.

Whereas the embodiment of the invention illustrated in FIGS. 4 and 5 incorporates both the first and fourth aspects of the invention, a shroud plate according to the present invention could incorporate only one of these two aspects of the invention. For instance a shroud plate could include the flange rim 43*c* but with a conventionally sized inner flange 42, or could include the radially extended inner flange 42 with a conventional slotted flange at its outer periphery as illustrated schematically in FIG. 6.

Referring to FIG. 6, three dimensions of a shroud plate according to a second embodiment of the fourth aspect the invention are illustrated, namely the radial extent of the shroud plate A, the axial thickness of the shroud plate wall C, and the axial extent of the inner flange 42 inboard the shroud plate wall B. In the prior art shroud 12, the ratio A:B is typically about 21 and the ratio B:C is typically about 0.75. The present inventors have found that extending the inner flange 42 to a length such that the ratio A:B is about 5 or less and/or the ratio B:C is about 1.5 or greater, substantially prevents crack formation at the vane slot trailing edge 25*b* in accordance with the present invention.

Both the first and fourth aspects of the invention provide advantages over the prior art shroud without requiring the radial shroud wall to be generally thickened which would be undesirable as it would increase the thermal mass of the shroud and could also be more expensive to manufacture as the vane slots have to be cut through the shroud wall. With embodiments which combine both the first and fourth aspects of the invention as for instance illustrated in FIGS. 4 and 5, the thermal mass at both the radially inner and outer peripheries of the shroud 40 can be balanced to improve thermal fatigue and durability.

A second aspect of the present invention is schematically illustrated in FIG. 7. This aspect of the invention may be applied to a conventional shroud plate 12 as illustrated, and the same reference numerals as used in FIGS. 3 to 5 will be used where appropriate. In FIG. 7 the shroud 12 is schematically illustrated in the manner of FIG. 3 and is shown fitted to a turbine housing 1 to define one wall of a turbine inlet 9, the opposing wall of which is defined by nozzle ring 11 which supports nozzle vanes 14. Nozzle vanes 14 extend through the shroud 12 into shroud cavity 13.

In accordance with the second aspect of the invention, flexing of the shroud 12 which may otherwise cause wear to the shroud plate is accommodated by enlarging the retaining ring receiving groove 50 defined by the housing 1. In particular, the groove 50 has a conical outboard sidewall 51 in common with the groove 18 of the known turbocharger, which interacts with the tapered retaining ring 19 to urge the shroud 12 in an inboard direction (relative to the shroud cavity 13), but the opposing inboard sidewall 52 of the groove 50 is sufficiently spaced from the retaining ring 19 that the two will not contact as a result of flexing in the shroud 12.

A radially extending annular shoulder 1*b* is defined around the mouth of the cavity 13 at the region of the inner peripheral edge of the shroud 12 and provides an abutment surface for the shroud inner flange 42. The shroud 12 is thus held firmly in position in the manner of the first embodiment of the invention described above. That is, there is no need for the retaining ring 1*a* to bear against the inboard sidewall of the groove 50 in order to retain the shroud in the correct position.

It will be appreciated that the second aspect of the invention could be combined with either, or both, of the first and fourth aspects of the invention by providing the shroud with an extended outer flange rim and/or axially extended inner flange.

As a modification to the third embodiment of the invention, the shroud could be maintained in position by abutment of the radially extending flange wall 27*b* with a modified annular shoulder 1*a* of the housing, rather than abutment of the inner shroud flange 42 with the radial shoulder 1*b* of the housing.

In accordance with a third aspect of the invention, the shroud retaining ring is replaced by use of a threaded locking ring in conjunction with a modified shroud as illustrated for instance in FIGS. 8 and 9. Both FIGS. 8 and 9 are cross-sections through a turbine housing 1 in accordance with two different embodiments of the third aspect of the invention.

Referring first to FIG. 8, a modified shroud 60 comprises a radially extending shroud wall 61 and axially extending inner and outer flanges 62 and 63 respectively. In addition, the outer periphery of the shroud 60 is provided with a radial flange wall 64 extending outwardly from the outer flange wall 63. In the illustrated embodiment of the inner flange 62 is also axially extended in accordance with the fourth aspect of the invention.

The shroud 60 is secured in position in the mouth of a shroud cavity 13 by a screw threaded retaining ring 65 which screws into the mouth of the shroud cavity 13 to clamp the outer periphery of the shroud 60 against an annular supporting ring 66. In more detail, the radially inner surface of the mouth of the shroud cavity 13 provides a seat for the shroud flange 32, and the radially outer surface of the mouth of the shroud cavity 13 is provided with an internal screw thread 67. The retaining ring 65 is generally L-shaped in cross-section having an axially extending screw threaded portion 65*a* and a radially extending portion 65*b*. The axially extending portion 65*a* screws into engagement with the threaded portion 67 of the housing 1, and the radially extending portion 65*b* clamps the radially extending flange wall 64 against the support ring 66 which is trapped between the flange wall 64 and an annular abutment shoulder 1*a* of the housing 1. At the inner periphery of the shroud 60, the shroud flange 62 abuts against an annular shoulder 1*b* of the housing.

The embodiment of FIG. 9 differs from the embodiment of FIG. 8 in that it omits the support ring 66, the shroud 60 being held in position by the inward (inboard) force exerted on radial shroud flange 64 by the retaining ring 65, and the outward (outboard) force exerted on the inner shroud flange 62 by the housing shoulder 1*b*.

In some embodiments of the invention the retaining ring 65 may hold the outer periphery of the shroud 60 in position without exerting a clamping force sufficient to prevent rotation of the shroud 60. That is, the shroud 60 may be allowed to rotate except to the extent that such rotation would be prevented by inlet vanes which extend through the shroud plate.

It will be appreciated that whereas the embodiments of the third aspect of the invention illustrated in FIGS. 8 and 9 also include an inner shroud flange in accordance with the fourth aspect of the invention, this need not necessarily be the case.

Whereas the present invention has been illustrated in relation to the turbine of a turbocharger, it will be appreciated that the invention may be applied to other turbines and turbomachines, such as for instance a variable geometry power turbine.

Other modifications which may be made to the illustrated embodiments of the invention will be readily apparent to the appropriately skilled person.

The invention claimed is:

1. A variable geometry turbine comprising:

a housing;

a turbine wheel supported in the housing for rotation about a turbine axis;

an annular inlet passage upstream of said turbine wheel defined between respective inlet surfaces defined by an annular nozzle ring and a facing annular shroud;

the annular nozzle ring being axial movable to vary the size of the inlet passage;

a circumferential array of inlet vanes supported by the annular nozzle ring and extending across the inlet passage;

the shroud covering the opening of a shroud cavity defined by the housing inlet passage and inboard of the shroud, and defining a circumferential array of vane slots, the vane slots and shroud cavity being configured to receive said inlet vanes to accommodate axial movement of the annular nozzle ring;

wherein the annular shroud comprises an outer flange around its radially outer periphery, the outer flange defining a circumferential flange groove for receiving a retaining ring for securing the shroud in the opening of the shroud cavity, the circumferential flange groove being defined on an inboard side by a radially extending flange wall;

wherein an annular flange rim extends axially inboard from said radially extending flange wall.

2. A variable geometry turbine according to claim 1, wherein the annular flange rim is a continuation of an axially extending annular flange wall which defines an annular base of the circumferential flange groove and extending axially beyond said radially extending flange wall.

3. A variable geometry turbine according to claim 2, wherein an annular gap is defined between the annular flange rim and inner surface of the housing defining a portion of the shroud cavity, wherein said annular gap increases in radial width along the length of the annular flange rim towards the inboard end of the annular flange rim.

4. A variable geometry turbine according to claim 3, wherein the annular flange rim has a radially outer surface and a radially inner surface, and wherein the radius of the radial outer surface reduces towards the inboard end of the annular flange rim.

5. A variable geometry turbine according to claim 4, wherein the radius of the inner surface of the annular flange rim is substantially constant, so that the annular flange rim tapers along its length towards its inboard end.

6. A variable geometry turbine comprising:

a housing;

a turbine wheel supported in the housing for rotation about a turbine axis;

an annular inlet passage upstream of said turbine wheel defined between respective inlet surfaces defined by an annular nozzle ring and a facing annular shroud;

the annular nozzle ring being axial movable to vary the size of the inlet passage;

a circumferential array of inlet vanes supported by the annular nozzle ring and extending across the annular inlet passage;

the annular shroud covering an opening of a shroud cavity defined by the annular inlet passage and inboard of the annular shroud, and defining a circumferential array of vane slots, the vane slots and shroud cavity being configured to receive said inlet vanes to accommodate axial movement of the annular nozzle ring;

wherein the annular shroud comprises an outer flange around its radially outer periphery, the outer flange defining a circumferential flange groove for receiving a retaining ring for securing the annular shroud in the opening of the shroud cavity, the circumferential flange groove being defined on an inboard side by a radially extending flange wall;

wherein the retaining ring is a substantially annular split ring having a radially inner portion received within the circumferential flange groove and the radially outer portion received within an annular groove defined by the housing to thereby key the annular shroud in position in the mouth of the shroud cavity;

the annular groove defined by the housing having an outboard sidewall, a base and an inboard side wall;

wherein the outboard face of the radially outer portion of the retaining ring and the outboard sidewall of the annular groove defined by the housing define corresponding frusto-conical surfaces which cooperate to bias the retaining ring in an inboard direction under a radial spring force of the retaining ring, thereby urging a portion of the shroud into contact with an abutment surface defined by the housing to secure the annular shroud in position in the mouth of the shroud cavity;

wherein the axial width of the annular groove defined by the housing is such that the inboard wall of the annular groove defined by the housing is spaced from the inboard surface of the radially outer portion of the retaining ring so that there is no contact between the two; and wherein the axial spacing between the inboard wall of the radially outer portion of the retaining ring and the inboard wall of the annular groove defined by the housing is at least equal to the maximum width of the retaining ring.

7. A variable geometry turbine comprising:

a housing;

a turbine wheel supported in the housing for rotation about a turbine axis;

an annular inlet passage upstream of said turbine wheel defined between respective inlet surfaces defined by an annular nozzle ring and a facing annular shroud;

the annular nozzle ring being axial movable to vary the size of the inlet passage;

a circumferential array of inlet vanes supported by the annular nozzle ring and extending across the annular inlet passage;

the annular shroud covering an opening of a shroud cavity defined by the annular inlet passage and inboard of the annular shroud, and defining a circumferential array of vane slots, the vane slots and shroud cavity being configured to receive said inlet vanes to accommodate axial movement of the annular nozzle ring;

wherein the annular shroud comprises an outer flange around its radially outer periphery, the outer flange defining a circumferential flange groove for receiving a retaining ring for securing the annular shroud in the opening of the shroud cavity, the circumferential flange groove being defined on an inboard side by a radially extending flange wall;

wherein the retaining ring is a substantially annular split ring having a radially inner portion received within the circumferential flange groove and the radially outer portion received within an annular groove defined by the housing to thereby key the annular shroud in position in the mouth of the shroud cavity;

the annular groove defined by the housing having an outboard sidewall, a base and an inboard side wall;

wherein the outboard face of the radially outer portion of the retaining ring and the outboard sidewall of the annular groove defined by the housing define corresponding frusto-conical surfaces which cooperate to bias the retaining ring in an inboard direction under a radial spring force of the retaining ring, thereby urging a portion of the shroud into contact with an abutment surface defined by the housing to secure the annular shroud in position in the mouth of the shroud cavity;

wherein the axial width of the annular groove defined by the housing is such that the inboard wall of the annular groove defined by the housing is spaced from the inboard surface of the radially outer portion of the retaining ring so that there is no contact between the two; and wherein the inboard wall of the annular groove defined by the housing extends to a smaller radius than the outer radius of the annular shroud, and wherein an axial gap is defined between said inboard wall of the annular groove defined by the housing and the outer flange of the annular shroud.

8. A variable geometry turbine comprising:

a housing;

a turbine wheel supported in the housing for rotation about a turbine axis;

an annular inlet passage upstream of said turbine wheel defined between respective inlet surfaces defined by an annular nozzle ring and a facing annular shroud;

the annular nozzle ring being axial movable to vary the size of the inlet passage;

a circumferential array of inlet vanes supported by the annular nozzle ring and extending across the annular inlet passage;

the annular shroud covering an opening of a shroud cavity defined by the annular inlet passage and inboard of the annular shroud, and defining a circumferential array of vane slots, the vane slots and shroud cavity being configured to receive said inlet vanes to accommodate axial movement of the annular nozzle ring;

wherein the annular shroud comprises an outer flange around its radially outer periphery, the outer flange defining a circumferential flange groove for receiving a retaining ring for securing the annular shroud in the opening of the shroud cavity, the circumferential flange groove being defined on an inboard side by a radially extending flange wall;

wherein the retaining ring is a substantially annular split ring having a radially inner portion received within the circumferential flange groove and the radially outer portion received within an annular groove defined by the housing to thereby key the annular shroud in position in the mouth of the shroud cavity;

the annular groove defined by the housing having an outboard sidewall, a base and an inboard side wall;

wherein the outboard face of the radially outer portion of the retaining ring and the outboard sidewall of the annular groove defined by the housing define corresponding frusto-conical surfaces which cooperate to bias the retaining ring in an inboard direction under a radial spring force of the retaining ring, thereby urging a portion of the shroud into contact with an abutment surface defined by the housing to secure the annular shroud in position in the mouth of the shroud cavity;

wherein the axial width of the annular groove defined by the housing is such that the inboard wall of the annular groove defined by the housing is spaced from the inboard surface of the radially outer portion of the retaining ring so that there is no contact between the two;

wherein the portion of the annular shroud which is urged against an abutment surface of the housing is at the radially inner periphery of the annular shroud; and wherein said portion of the annular shroud which is urged into contact with an abutment surface of the housing, is an axially extending inboard flange at the radially inner periphery of the annular shroud.

9. A variable geometry turbine comprising:

a housing;

a turbine wheel supported in the housing for rotation about a turbine axis;

an annular inlet passage upstream of said turbine wheel defined between respective inlet surfaces defined by an annular nozzle ring and a facing annular shroud;

the annular nozzle ring being axial movable to vary the size of the inlet passage;

a circumferential array of inlet vanes supported by the annular nozzle ring and extending across the annular inlet passage;

the annular shroud covering an opening of a shroud cavity defined by the annular inlet passage and inboard of the annular shroud, and defining a circumferential array of vane slots, the vane slots and shroud cavity being configured to receive said inlet vanes to accommodate axial movement of the annular nozzle ring;

wherein the annular shroud comprises an outer flange around its radially outer periphery, the outer flange defining a circumferential flange groove for receiving a retaining ring for securing the annular shroud in the opening of the shroud cavity, the circumferential flange groove being defined on an inboard side by a radially extending flange wall;

wherein the retaining ring is a substantially annular split ring having a radially inner portion received within the circumferential flange groove and the radially outer portion received within an annular groove defined by the housing to thereby key the annular shroud in position in the mouth of the shroud cavity;

the annular groove defined by the housing having an outboard sidewall, a base and an inboard side wall;

wherein the outboard face of the radially outer portion of the retaining ring and the outboard sidewall of the annular groove defined by the housing define corresponding frusto-conical surfaces which cooperate to bias the retaining ring in an inboard direction under a radial spring force of the retaining ring, thereby urging a portion of the shroud into contact with an abutment surface defined by the housing to secure the annular shroud in position in the mouth of the shroud cavity; and wherein the axial width of the annular groove defined by the housing is such that the inboard wall of the annular groove defined by the housing is spaced from the inboard surface of the radially outer portion of the retaining ring so that there is no contact between the two; and wherein the portion of the annular shroud urged into contact with an abutment surface of the housing is a portion of the radially outer flange.

10. A variable geometry turbine comprising:

a housing;

a turbine wheel supported in the housing for rotation about a turbine axis;

an annular inlet passage upstream of said turbine wheel defined between respective inlet surfaces defined by an annular nozzle ring and a facing annular shroud;

the annular nozzle ring being axial movable to vary the size of the inlet passage;

a circumferential array of inlet vanes supported by the annular nozzle ring and extending across the inlet passage;

the annular shroud covering an opening of a shroud cavity defined by the housing inlet passage and inboard of the annular shroud, and defining a circumferential array of vane slots, the vane slots and shroud cavity being configured to receive said inlet vanes to accommodate axial movement of the annular nozzle ring;

wherein the annular shroud comprises a radially extending outer flange wall around its radially outer periphery;

wherein the housing defines an internally screw threaded annular surface around the opening of the shroud cavity;

wherein the annular shroud is retained in position by a retaining ring provided with a screw threaded outer surface which engages said screw threaded surface of the housing and wherein a portion of the retaining ring bears against the radially extending outer flange wall of the annular shroud; and wherein the retaining ring has a radially extending outboard portion and an axially extending inboard portion, wherein said inboard portion defines said screw threaded surface for engagement with the screw threaded surface of the housing, and wherein the radially extending outboard portion bears against the radially extending outer flange wall of the annular shroud.

11. A variable geometry turbine according to claim 10, wherein the radially extending outer flange wall of the annular shroud is trapped between the radially extending portion of the retaining ring and an annular support ring located within the opening of the shroud cavity.

12. A variable geometry turbine according to claim 10, wherein the annular shroud has an inner annular flange extending radially inboard at its inner periphery, and wherein the inboard end of the inner flange is urged against an abutment surface of the housing by axial force applied to the annular shroud by the retaining ring.

13. A variable geometry turbine according to claim 10, wherein the radially extending outer flange wall of the annular shroud extends radially from the inboard end of an axially extending shroud flange wall.

14. A variable geometry turbine according to claim 13, where a radial outboard surface of the retaining ring is substantially aligned with the radial outboard surface of the annular shroud.

15. A variable geometry turbine comprising:

a housing;

a turbine wheel supported in the housing for rotation about a turbine axis;

an annular inlet passage upstream of said turbine wheel defined between respective inlet surfaces defined by an annular nozzle ring and a facing annular shroud;

the annular nozzle ring being axial movable to vary the size of the inlet passage;

a circumferential array of inlet vanes supported by the annular nozzle ring and extending across the inlet passage;

the annular shroud covering an opening of a shroud cavity defined by the housing inlet passage and inboard of the annular shroud, and defining a circumferential array of vane slots, the vane slots and shroud cavity being configured to receive said inlet vanes to accommodate axial movement of the annular nozzle ring;

wherein the annular shroud comprises a radially extending outer flange wall around its radially outer periphery;

wherein the housing defines an internally screw threaded annular surface around the opening of the shroud cavity;

wherein the annular shroud is retained in position by a retaining ring provided with a screw threaded outer surface which engages said screw threaded surface of the housing and wherein a portion of the retaining ring bears against the radially extending outer flange wall of the annular shroud;

wherein the retaining ring has a radially extending outboard portion and an axially extending inboard portion, wherein said inboard portion defines said screw threaded surface for engagement with the screw threaded surface of the housing, and wherein the radially extending outboard portion bears against the radially extending outer flange wall of the annular shroud; and wherein the radially extending outer flange wall of the annular shroud is trapped between the radially extending portion of the retaining ring and an annular support ring located within the opening of the shroud cavity.

16. A variable geometry turbine comprising:

a housing;

a turbine wheel supported in the housing for rotation about a turbine axis;

an annular inlet passage upstream of said turbine wheel defined between respective inlet surfaces defined by an annular nozzle ring and a facing annular shroud;

the annular nozzle ring being axial movable to vary the size of the inlet passage;

a circumferential array of inlet vanes supported by the annular nozzle ring and extending across the inlet passage;

the annular shroud covering an opening of a shroud cavity defined by the housing inlet passage and inboard of the annular shroud, and defining a circumferential array of vane slots, the vane slots and shroud cavity being configured to receive said inlet vanes to accommodate axial movement of the annular nozzle ring;

wherein the annular shroud comprises a radially extending outer flange wall around its radially outer periphery;

wherein the housing defines an internally screw threaded annular surface around the opening of the shroud cavity;

wherein the annular shroud is retained in position by a retaining ring provided with a screw threaded outer surface which engages said screw threaded surface of the housing and wherein a portion of the retaining ring bears against the radially extending outer flange wall of the annular shroud;

wherein the retaining ring has a radially extending outboard portion and an axially extending inboard portion, wherein said inboard portion defines said screw threaded surface for engagement with the screw threaded surface of the housing, and wherein the radially extending outboard portion bears against the radially extending outer flange wall of the annular shroud; and wherein the annular shroud has an inner annular flange extending radially inboard at its inner periphery, and wherein the inboard end of the inner flange is urged against an abutment surface of the housing by axial force applied to the annular shroud by the retaining ring.

17. A variable geometry turbine comprising:

a housing;

a turbine wheel supported in the housing for rotation about a turbine axis;

an annular inlet passage upstream of said turbine wheel defined between respective inlet surfaces defined by an annular nozzle ring and a facing annular shroud;

the annular nozzle ring being axial movable to vary the size of the inlet passage;

a circumferential array of inlet vanes supported by the annular nozzle ring and extending across the inlet passage;

the annular shroud covering an opening of a shroud cavity defined by the housing inlet passage and inboard of the annular shroud, and defining a circumferential array of vane slots, the vane slots and shroud cavity being configured to receive said inlet vanes to accommodate axial movement of the annular nozzle ring;

wherein the annular shroud comprises a radially extending outer flange wall around its radially outer periphery;

wherein the housing defines an internally screw threaded annular surface around the opening of the shroud cavity;

wherein the annular shroud is retained in position by a retaining ring provided with a screw threaded outer surface which engages said screw threaded surface of the housing and wherein a portion of the retaining ring bears against the radially extending outer flange wall of the annular shroud;

wherein the retaining ring has a radially extending outboard portion and an axially extending inboard portion, wherein said inboard portion defines said screw threaded surface for engagement with the screw threaded surface of the housing, and wherein the radially extending outboard portion bears against the radially extending outer flange wall of the annular shroud; and wherein the radially extending outer flange wall of the annular shroud extends radially from the inboard end of an axially extending shroud flange wall.

18. A variable geometry turbine according to claim 17, wherein a radial outboard surface of the retaining ring is substantially aligned with the radial outboard surface of the annular shroud.

* * * * *